US009700105B2

(12) United States Patent
Kaikou et al.

(10) Patent No.: US 9,700,105 B2
(45) Date of Patent: Jul. 11, 2017

(54) SURFACE FASTENER AND SURFACE FASTENER LATCH ELEMENT COMBINATION

(75) Inventors: Takayoshi Kaikou, Fukui (JP); Masami Yamashita, Fukui (JP)

(73) Assignee: KURARAY FASTENING CO., LTD., Osaka-shi (JP)

( * ) Notice: Subject to any disclaimer, the term of this patent is extended or adjusted under 35 U.S.C. 154(b) by 391 days.

(21) Appl. No.: 14/346,603

(22) PCT Filed: Sep. 3, 2012

(86) PCT No.: PCT/JP2012/072381

§ 371 (c)(1),
(2), (4) Date: Mar. 21, 2014

(87) PCT Pub. No.: WO2013/047098

PCT Pub. Date: Apr. 4, 2013

(65) Prior Publication Data

US 2014/0230123 A1 Aug. 21, 2014

(30) Foreign Application Priority Data

Sep. 28, 2011 (JP) ..... 2011-212395
May 25, 2012 (JP) ..... 2012-119272

(51) Int. Cl.
*A44B 18/00* (2006.01)

(52) U.S. Cl.
CPC ..... *A44B 18/0046* (2013.01); *A44B 18/003* (2013.01); *A44B 18/0073* (2013.01);
(Continued)

(58) Field of Classification Search
CPC ..... A44B 18/0046; A44B 18/0061; A44B 18/0057; A44B 18/0053; A44B 18/0088; Y10T 24/2742; Y10T 24/2775
See application file for complete search history.

(56) References Cited

U.S. PATENT DOCUMENTS 5,231,738 A * 8/1993 Higashinaka ..... A44B 18/003 24/446
5,996,189 A 12/1999 Wang
(Continued)

FOREIGN PATENT DOCUMENTS

EP 1 764 009 A1 3/2007
JP 02-6516 U 1/1990
(Continued)

OTHER PUBLICATIONS

International Search Report issued Dec. 4, 2012 in PCT/JP2012/072381.
(Continued)

*Primary Examiner* — Jack W Lavinder
(74) *Attorney, Agent, or Firm* — Oblon, McClelland, Maier & Neustadt, L.L.P.

(57) ABSTRACT

A surface fastener which includes a hook surface fastener (A) and a loop surface fastener (B), or a mixed surface fastener (C). The hook surface fastener (A) has hook fastener elements made of monofilaments on a surface of a base fabric. The loop surface fastener (B) has loop fastener elements made of multifilaments and capable of engaging with the hook fastener elements on a surface of a base fabric. The mixed surface fastener (C) has hook fastener elements made of monofilaments and loop fastener elements made of multifilaments on the same surface of a base fabric. The monofilaments are made from a polyethylene terephthalate-based polyester resin, and the multifilaments are made of a polybutylene terephthalate-based polyester resin.

12 Claims, 1 Drawing Sheet

(52) U.S. Cl.
CPC ..... *A44B 18/0088* (2013.01); *Y10T 24/275* (2015.01); *Y10T 24/2742* (2015.01); *Y10T 24/2758* (2015.01)

(56) References Cited

U.S. PATENT DOCUMENTS

| | | | | |
|---|---|---|---|---|
| 6,443,187 | B1 * | 9/2002 | Wang ..... | A44B 18/0023 139/391 |
| 6,546,603 | B1 | 4/2003 | Wang et al. | |
| 2002/0185192 | A1 | 12/2002 | Fisher et al. | |
| 2003/0101549 | A1 | 6/2003 | Wang et al. | |
| 2010/0043183 | A1 * | 2/2010 | Higashinaka ..... | A44B 18/0038 24/452 |

FOREIGN PATENT DOCUMENTS

| | | | |
|---|---|---|---|
| JP | 05-154009 | A | 6/1993 |
| JP | 2002-223817 | A | 8/2002 |
| JP | 2002-238621 | A | 8/2002 |
| JP | 2003-125813 | A | 5/2003 |
| JP | 2003-515409 | A | 5/2003 |
| JP | 2006-034872 | A | 2/2006 |
| JP | 2011-110311 | A | 6/2011 |
| TW | 517535 | U | 1/2003 |
| TW | I244904 | B | 12/2005 |
| TW | M303649 | U | 1/2007 |
| WO | WO 2005/122817 | A1 | 12/2005 |
| WO | WO 2007/074791 | A1 | 7/2007 |

OTHER PUBLICATIONS

Extended European Search Report issued Mar. 27, 2015 in Patent Application No. 12835014.7.

Combined Office Action and Search Report issued on Aug. 10, 2016 in Taiwanese Patent Application No. 101135278 (with English translation of categories of cited documents).

* cited by examiner

SURFACE FASTENER AND SURFACE FASTENER LATCH ELEMENT COMBINATION

CROSS REFERENCE TO RELATED APPLICATION

This application is a 371 of PCT/JP2012/072381, filed on Sep. 3, 2012, and claims priority to the following Japanese Patent Applications: i) JP 2011-212395, filed on Sep. 28, 2011; and ii)JP 2012-119272, filed on May 25, 2012.

TECHNICAL FIELD

The present invention relates to a hook surface fastener and a loop surface fastener, each comprising fastener elements formed by polyester fibers; a mixed hook/loop surface fastener wherein hook fastener elements and loop fastener elements, each formed by polyester fibers, are mixed together; and a combination of the hook fastener elements and the loop fastener elements.

BACKGROUND ART

One of the means for fastening an object to the surface of another object which has been conventionally used is a method of using surface fasteners. In this method, a male surface fastener having hook fastener elements is fixed onto the surface of one object and a female surface fastener having loop fastener elements is fixed onto the surface of the other object. By overlaying one surface fastener to the other and engaging both fastener elements with each other, one object is fixed to the surface of the other object. Various surface fasteners made of different materials, for example, a fabric surface fastener, and employing different fastening systems have been used.

A combination of fabric surface fasteners, for example, a combination of a hook surface fastener (A) having hook fastener elements formed by monofilaments on a base fabric and a loop surface fastener (B) having loop fastener elements formed by multifilaments which are capable of engaging with the hook fastener elements on a base fabric have been widely known. The fabric surface fasteners are sold in a bag with both types of surface fasteners being engaged with each other and widely used in many fields, for example, clothes, shoes, headwear, belts, supporters, pillow covers, bags, sphygmomanometers, other miscellaneous daily goods, binding tapes, package materials, civil engineering and construction materials, and agriculture and fishery materials, and toys.

A mixed hook/loop surface fastener wherein the hook fastener elements and the loop fastener elements are mixedly formed in the same surface of a base fabric is also known. Compared with the conventional fastening device which needs two separate surface fasteners wherein one has hook fastener elements and the other has loop fastener element, the mixed hook/loop surface fastener needs only one type of surface fastener for fastening and the demand for it has been recently increased.

Each of the hook surface fastener (A) and the loop surface fastener (B) are generally produced by forming each of the hook fastener elements and the loop fastener elements at the time a base fabric comprising ground warp yarns and ground weft yarns is produced. Namely, the hook surface fastener (A) is produced by feeding monofilaments for forming the hook fastener elements into the base fabric in parallel to the ground warp yarns, projecting the monofilaments from the base fabric at intervals so as to form loops, heat-setting the loops, and then cutting loops at one leg to form the hook fastener elements. The loop surface fastener (B) is produced by feeding multifilaments for forming loop fastener elements into the base fabric in parallel to the ground warp yarns and projecting the multifilaments from the base fabric at intervals in a form of loops to form the loop fastener elements.

As the ground warp yarn, the ground weft yarn, the monofilament for the hook fastener element, and the multifilament for the loop fastener element, which are main components of the hook surface fastener (A) and the loop surface fastener (B), fibers formed from a polyamide polymer, such as nylon 6, nylon 66, and nylon 610, or a copolymer mainly based thereon have been generally used. However, a base fabric employing a polyamide fiber changes its shape and, in some cases, loses its shape by waving due to water and moisture absorption. Therefore, the polyamide fiber has significant disadvantages of impairing the quality and high-grade appearance of the product to which a surface fastener is attached and not necessarily providing a high engagement strength, which is the most important property required for the surface fastener.

These days, clothes are mainly fabricated from polyester fiber. When a surface fastener made of polyamide is attached to polyester clothes, polyamide and polyester are difficult to dye under the same dyeing condition due to the significant difference in their dyeabilities. Therefore, a large number of surface fasteners with various color shades which match the colors of the final products should be stored to assure uniform color shades between polyamide and polyester.

To eliminate the disadvantage in the use of polyamide fiber, the use of a fiber formed from a polyester polymer such as a low water and moisture absorbing polyethylene terephthalate or polybutylene terephthalate and a copolymer mainly based thereon has been considered recently. Some documents actually report the use of polyester fiber for the surface fastener.

For example, Patent Document 1 reports, in addition to the use of a synthetic fiber formed from a polyamide polymer such as nylon 6, nylon 66 and nylon 610, a synthetic fiber formed from a polyester polymer such as polyethylene terephthalate, polybutylene terephthalate and a copolymer mainly based thereon is usable as the fiber for forming the fastener element of surface fastener and a knitted woven fabric for carrying the fastener elements.

Patent Document 2 teaches to form the base fabric of surface fastener from, in addition to a fiber formed from polyamide such as nylon 6 and nylon 66, a fiber formed from polyester such as polyethylene terephthalate and polybutylene terephthalate. The document further teaches that a monofilament of nylon or polyester is preferred for the hook fastener element, and a multifilament of nylon or polyester is preferred for the loop fastener element.

The inventors had studied the surface fastener made by using a polyester fiber, i.e., the main fiber for clothes in these days, which is free from the significant disadvantage of waving due to water and moisture absorption found in the surface fastener made of a polyamide fiber. As a result, the inventors have found that the loop fastener element made of a multifilament of polyethylene terephthalate-based polyester had the disadvantage of failing to provide a high engagement strength, because the multifilament which form the loop was hardly separated into individual filaments. In addition, the surface fastener was hard in touch and not necessarily suitable for the application requiring a soft touch, such as clothes and daily necessities. It has been further found that the hook fastener element made of a monofilament of polybutylene terephthalate-based polyester failed to provide a sufficient engagement strength, because the hook fastener element engaged with the loop yarn was easily deformed and disengaged from the loop yarn by a small pulling force.

To prevent, the hook fastener elements and the loop fastener elements from being pulled out of the base fabric by a force for disengagement, the resistance to pull-out has been enhanced in a conventional technique by applying an adhesive (back coat resin) to the back surface of the base fabric to anchor the yarns which form the fastener elements to the base fabric. However, since the adhesive makes the base fabric hard and stiff, the resultant product is not suitable for use in clothing applications which require flexibility. In another known technique (Patent Document 3), the resistance to pull-out is enhanced by using a heat fusible fiber as the fiber for forming the surface fastener, and fusing the fibers for forming the fastener element to fusion-bond the fused fibers to the base fabric. When polyamide fibers are used as the fiber for forming the base fabric, the fiber performance is significantly reduced by the thermal fusion bonding, because the polyamide fibers are poor in heat resistance.

Since the hook surface fastener and the loop surface fastener are manufactured by the same maker, the surface fastener commercially available includes the hook fastener elements and the loop fastener elements, both made from the same resin. For example, when the hook fastener elements are made of nylon 6 monofilaments, the cooperating loop fastener elements are made of nylon 6 multifilaments. When the hook fastener elements are made of polyethylene terephthalate monofilaments, the cooperating loop fastener elements are made of polyethylene terephthalate multifilaments.

The reason for the above may be because the hook surface fastener and the loop surface fastener are manufactured by the same maker; and the hook surface fastener and the loop surface fastener are attached to the same object, and therefore the same dyeability is required for the hook surface fastener and the loop surface fastener. In addition, the engagement strength of surface fastener can be varied freely to some extent by changing the fineness of the monofilament for forming the hook fastener elements, the number of filaments in the multifilament for forming the loop fastener elements, and the fastener element density per unit area. The above reasons may have led a skilled person away from using a monofilament for forming hook fastener elements and a multifilament for forming loop fastener elements which are made from different resins.

Patent Document 4 describes a mixed hook/loop surface fastener having, on the same surface of the base fabric, the hook fastener elements with 1.3 to 3.8 mm height and the loop fastener elements with 1.5 to 4 mm height which is higher than that of the hook fastener elements by 0.2 to 2 mm. The document teaches that fibers of a thermoplastic resin, such as polyamide, polyester, polypropylene, and polyethylene, are usable as the fibers for forming the hook fastener elements and the loop fastener elements.

Patent Document 5 describes a mixed hook/loop surface fastener having the hook fastener elements and the loop fastener elements on the same base fabric, wherein the engagement is not formed by a small load, but formed only by applying a large load. The document teaches that synthetic fibers, such as polyamide fiber, polyester fiber, and polyolefin fiber, are usable as the fibers for forming the hook fastener elements and the loop fastener elements, with fibers of polyamide such as nylon-6 and nylon-66 and fibers of polyester such as polyethylene terephthalate and polybutylene terephthalate being preferred.

However, these patent documents merely describe in their working examples that polyester fibers are used for forming the hook fastener elements and the loop fastener elements and that the hook fastener elements are formed by polyester monofilaments and the loop fastener elements are formed by nylon-66 multifilaments.

The inventors have studied a mixed surface fastener in which the hook fastener elements and the loop fastener elements are both made of polyethylene terephthalate-based fibers and have found that each multifilament which forms the loop fastener elements is difficult to separate into individual filaments to prevent the hook fastener elements from entering into the loops of the loop fastener elements, thereby failing to obtain a sufficient engagement strength. The inventors have further found that a sufficient engagement strength cannot be obtained also in a mixed surface fastener in which the hook fastener elements and the loop fastener elements are both made of polybutylene terephthalate-based fibers, because the hook fastener elements are excessively soft. It has been further found that a sufficient engagement strength cannot be obtained even when trying to increase the engagement strength by forming the hook fastener elements from monofilaments having a larger fineness, because the hook fastener elements are difficult to enter into the loop fastener elements.

It has been further found that a surface fastener wherein the hook fastener elements or the loop fastener elements are formed of nylon fibers is poor in the dimension stability to humidity and waves when absorbing water. In the conventional technique, to prevent the hook fastener elements and the loop fastener element from being pulled out of the surface fastener during disengagement, an adhesive is applied to the back surface of the base fabric to enhance the resistance to pull-out of the fastener elements. However, the base fabric becomes hard and stiff by applying an adhesive to the back surface of the base fabric, and the obtained product is not suitable for use in clothing applications which require flexibility. In another known technique to enhance the resistance to pull-out of the fastener elements, a heat fusible fiber is used for forming the surface fastener, and the fibers which form the fastener elements are fusion-bonded to the fused fibers in the base fabric (Patent Document 3). When polyamide fibers are used as the fiber for forming the base fabric, the fiber performance is significantly reduced by the thermal fusion bonding because the polyamide fibers are poor in heat resistance.

Patent Document 1: JP 2002-238621A
Patent Document 2: JP 2002-223817A
Patent Document 3: WO 2005/122817
Patent Document 4: JP 5-154009A
Patent Document 5: JP 2003-125813A

DISCLOSURE OF THE INVENTION

An object of the present invention is to provide a combination of a hook surface fastener and a loop surface fastener free from the above disadvantages, in which the engagement strength is high; the surface fasteners do not wave by moisture or water absorption; and the cooperating surface fasteners have almost the same dyeability. In a preferred embodiment, the hook fastener elements and the loop fastener elements are firmly anchored to the base fabric at their roots by heat fusion bonding; the engagement is well durable, i.e., the engagement strength is less reduced despite repeated engagement and disengagement; and the base fabric is flexible because the base fabric has no back coat resin layer.

Another object of the present invention is to provide a mixed hook/loop surface fastener (also referred to simply as "mixed surface fastener") having a high engagement strength. In a preferred embodiment, the hook fastener elements and the loop fastener elements are firmly anchored to the base fabric at their roots by heat fusion bonding; and the engagement is well durable, i.e., the engagement strength is hardly reduced despite repeated engagement and disengagement.

The present invention includes a first invention (also referred to as "invention 1") and a second invention (also referred to as "invention 2").

The invention 1 relates to a surface fastener comprising a hook surface fastener (A) which comprises hook fastener elements comprising monofilaments on a surface of a base fabric and a loop surface fastener (B) which comprises loop fastener elements capable of engaging with the hook fastener elements and comprising multifilaments on a surface of a base fabric; or comprising a mixed surface fastener (C) which comprises hook fastener elements comprising monofilaments and loop fastener elements comprising multifilaments both on the same surface of a base fabric, wherein the monofilaments comprises a polyethylene terephthalate-based polyester resin, and the multifilaments comprises a polybutylene terephthalate-based polyester resin.

The invention 1 includes a first embodiment relating to the hook surface fastener (A) which comprises the hook fastener elements comprising the monofilaments on the surface of the base fabric, and the loop surface fastener (B) which comprises the loop fastener elements capable of engaging with the hook fastener elements and comprising the multifilaments on the surface of the base fabric; and a second embodiment relating to the mixed surface fastener (C) which comprises the hook fastener elements comprising the monofilaments and the loop fastener elements comprising the multifilaments both on the same surface of the base fabric.

In a preferred embodiment of the invention 1, i.e., in both the first embodiment relating to the hook surface fastener (A) and the loop surface fastener (B) and the second embodiment relating to the mixed surface fastener (C), both the ground warp yarns and the ground weft yarns each forming the base fabric comprise a polyester resin, the ground weft yarns comprise sheath-core heat fusible fibers, and the hook fastener elements and the loop fastener elements are anchored by fusion bonding to the ground weft yarns which form the base fabric.

In a more preferred first embodiment of the invention 1, the multifilament forming the loop fastener element of the loop surface fastener (B) is a multifilament yarn having 5 to 15 filaments and a total fineness of 150 to 300 dtex, and the monofilament forming the hook fastener element of the hook surface fasteners (A) is a monofilament yarn having a diameter of 0.13 to 0.40 mm. In addition, the density of the hook fastener elements of the hook surface fastener (A) is 20 to 120 elements/$cm^2$, and the density of the loop fastener elements of the loop surface fastener (B) is 20 to 120 elements/$cm^2$.

In another preferred first embodiment of the invention 1, the base fabric of the hook surface fastener (A) and the base fabric of the loop surface fastener (B) are integrally bonded to each other with both the surfaces having the fastener elements disposed outside.

In a preferred second embodiment of the invention 1 relating to the mixed hook/loop surface fastener (C), the multifilament forming the loop fastener element is a multifilament yarn having 5 to 9 filaments and a total fineness of 150 to 350 dtex, and the monofilament forming the hook fastener element is a monofilament yarn having a diameter of 0.10 to 0.25 mm. In addition, at least one array of the hook fastener elements is disposed adjacent to at least one array of the loop fastener elements. Further, the loop fastener elements are higher than the hook fastener elements by 0.2 mm or more. Still further, the mixed hook/loop surface fastener is used as a substitute for buttons of clothing.

The invention 2 relates to a fastener element combination for surface fastener which comprises hook fastener elements and loop fastener elements capable of engaging with the hook fastener elements, wherein the hook fastener elements comprise monofilaments comprising a polyethylene terephthalate-based polyester resin, and the loop fastener elements comprise the multifilaments comprising a polybutylene terephthalate-based polyester resin.

Preferred are the first embodiment of the fastener element combination for surface fastener, wherein the hook fastener elements are formed on a surface of the base fabric of a hook surface fastener (A) and the loop fastener elements are formed on a surface of the base fabric of a loop surface fastener (B); and the second embodiment of the fastener element combination for surface fastener, wherein the hook fastener elements and the loop fastener elements are formed on the same surface of the base fabric of the mixed surface fastener (C); wherein each of the ground warp yarns and the ground weft yarns which form the base fabric of each of the hook surface fastener (A) and the loop surface fastener (B) of the first embodiment and the base fabric of the mixed surface fastener (C) of the second embodiment comprises a polyester resin; and wherein the ground weft yarns comprise a sheath-core heat fusible fibers, and the hook fastener elements and the loop fastener elements are anchored by fusion bonding to the ground weft yarns which form the base fabric.

REFERENCE NUMERALS

Figure 1A:
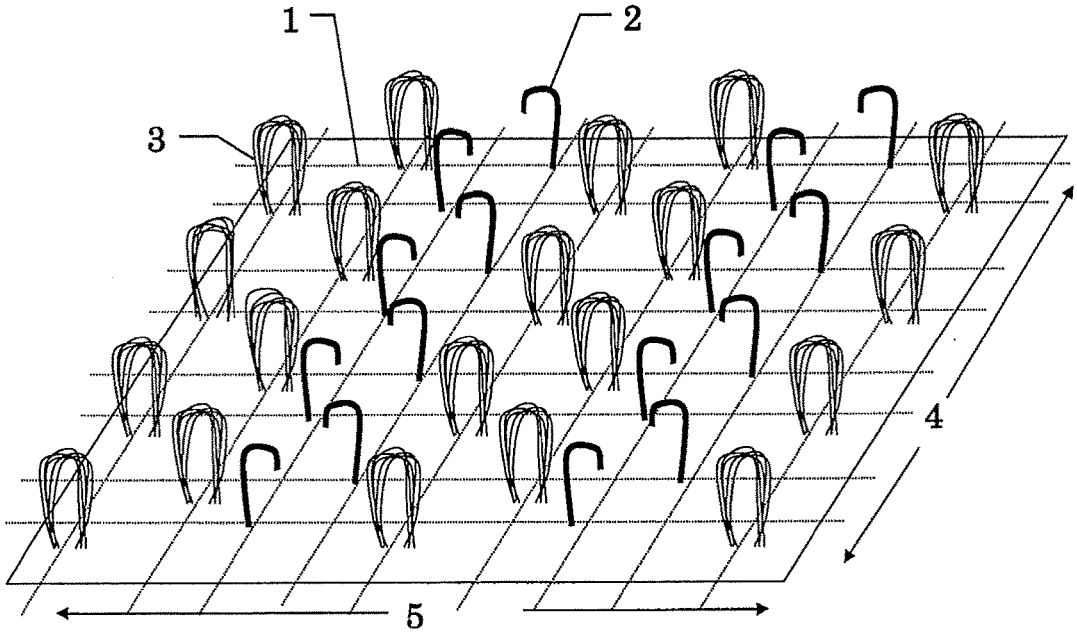
Fig. 1A is a perspective view showing an example of a mixed hook/loop surface fastener (C) of the second embodiment of the invention 1.
Figure 1B:
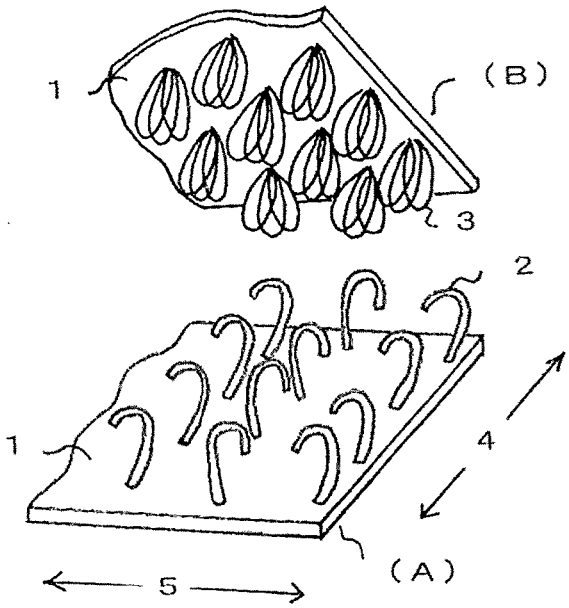
FIG. 1B is a perspective view showing an example of a hook surface fastener (A) on a surface of a base fabric and a loop surface fastener (B) on a surface of a base fabric.

1: Base fabric
2: Hook fastener element
3: Loop fastener element
4: Warp direction
5: Weft direction Most Preferred Embodiment to Carry Out the Invention In the first embodiment of the invention 1, the hook surface fastener (A) is mainly made of the monofilaments for forming the hook fastener elements, the ground warp yarns and the ground weft yarns, and the cooperating loop surface fastener (B) is mainly made of the multifilaments for forming the loop fastener elements, the ground warp yarns and the ground weft yarns.

The hook fastener elements of the hook surface fastener (A) of the first embodiment and the hook fastener elements of the mixed surface fastener (C) of the second embodiment are required to be rigid and hold their shapes without deforming by a small force, i.e., required to have a hook-shape retaining property. To meet these requirements, the monofilament is made of a thick synthetic fiber. In the present invention, the monofilament made of a polyethylene terephthalate-based polyester excellent in the hook-shape retaining property is particularly used.

The polyethylene terephthalate-based polyester referred to herein is a polyester mainly comprising ethylene terephthalate units and is obtained by the condensation reaction between mainly terephthalic acid and ethylene glycol, which may include a small amount of units other than the terephthalic acid units and the ethylene glycol units, for example, unit of aromatic dicarboxylic acid, such as isophthalic acid, sodium sulfoisophthalate, phthalic acid, and naphthalenedicarboxylic acid; unit of aliphatic dicarboxylic acid, such as adipic acid and sebacic acid; unit of diol, such as propylene glycol and butylene glycol; unit of oxycarboxylic acid, such as hydroxybenzoic acid and lactic acid; and unit of monocarboxylic acid, such as benzoic acid. The polyethylene terephthalate-based polyester may be added with a small amount of another polymer. The polyethylene terephthalate-based polyester is preferably a polyethylene terephthalate homopolymer. In any case, it is recommended to use the monofilaments mainly made of the polyethylene terephthalate-based polyester which has a melting point enough to prevent the monofilaments from being melted at the heat treatment temperature mentioned below.

The monofilaments for forming the hook fastener elements which are made from the polyethylene terephthalate-based polyester are highly rigid, and the Young's modulus of the monofilaments is preferably 80 to 140 cN/dtex, because the hook fastener elements are made more rigid and made difficult to disengage from the loop fastener elements, thereby obtaining a high engagement strength.

The diameter of the monofilament for the hook fastener element which is made of the polyester mentioned above is preferably 0.13 to 0.40 mm and more preferably 0.18 to 0.35 mm, in case of forming the hook surface fastener (A). Although the above diameter is slightly larger than those of the hook fastener elements generally used in known surface fasteners, the diameter of the above range is attributable to a high engagement strength of the combination of the hook surface fastener (A) and the loop surface fastener (B) mentioned blew.

The diameter of the monofilament for the hook fastener element which is made of the polyester mentioned above is preferably 0.10 to 0.25 mm and more preferably 0.12 to 0.22 mm, in case of forming the hook fastener elements of the mixed surface fastener (C) according to the second embodiment, because the hook fastener elements are formed easily.

Although the above diameter is slightly smaller than those of the hook fastener elements generally used in known surface fasteners, the diameter of the above range makes the mixed hook/loop surface fastener flexible and makes the final product suitable for clothing applications.

In the invention 1, the loop fastener elements forming the loop surface fastener (B) of the first embodiment and the loop fastener elements forming the mixed surface fastener (C) of the second embodiment are made of multifilament yarns comprising a polybutylene terephthalate-based polyester. The polybutylene terephthalate-based polyester referred to herein is a polyester mainly comprising butylene terephthalate units and is obtained by the condensation reaction between mainly terephthalic acid and 1,4-butanediol, which may include a small amount of units other than the terephthalic acid units and the 1,4-butanediol units, for example, unit of aromatic dicarboxylic acid, such as isophthalic acid, sodium sulfoisophthalate, phthalic acid, and naphthalenedicarboxylic acid; unit of aliphatic dicarboxylic acid, such as adipic acid and sebacic acid; unit of diol, such as ethylene glycol and propylene glycol; unit of oxycarboxylic acid, such as hydroxybenzoic acid and lactic acid; and unit of monocarboxylic acid, such as benzoic acid. The polybutylene terephthalate-based polyester may be added with a small amount of antoher polymer.

In the loop surface fastener (B) of the first embodiment, the multifilament for forming the loop fastener element made from the polybutylene terephthalate-based polyester is preferably a multifilament yarn having 5 to 15 filaments and a total fineness of 150 to 300 dtex. When the loop fastener elements are intended to be anchored by fusion bonding to the ground weft yarns forming the base fabric, some filaments in the multifilament yarn may be not anchored by fusion bonding, if the number of filaments is large. The filaments not anchored by fusion bonding are pulled out during repeated engagement and disengagement. Therefore, the number of filaments for forming the loop fastener element is preferably small for achieving a good durability of engagement, and the number of filaments in the multifilament yarn employed in the present invention is slightly smaller than those of the multifilaments generally used in known loop fastener elements. More preferred is a multifilament having 5 to 10 filaments and a total fineness of 150 to 280 dtex.

The reduction in the number of filaments in the loop fastener element means to reduce the number of hook fastener elements which can engage with the loop fastener elements. If the loop fastener elements are made from a polyethylene terephthalate-based polyester, the individual filaments are likely to bind together due to a high Young's modulus to increase rigidity, failing to obtain a high engagement strength when engaged by a small load. Therefore, the filaments in the loop fastener element should be separated into individual filaments, for example, by slightly rubbing with a card clothing. In the present invention, it is important to form the multifilament yarns for the loop fastener elements from the polybutylene terephthalate-based polyester, preferably to use the multifilament yarn having a Young's modulus of 15 to 35 cN/dtex, because the flexibility makes the filaments in the loop fastener element to be easily separated and the hook fastener elements easily catch the separated loop fastener elements to ensure a high engagement strength even when engaged by a small load.

In the mixed surface fastener (C) of the second embodiment, the multifilament for the loop fastener element which is made from the polybutylene terephthalate-based polyester is preferably a multifilament yarn having 5 to 9 filaments and a total fineness of 150 to 350 dtex. To firmly anchor the loop fastener elements to the base fabric by heat fusion bonding, the number of filaments in the loop fastener element is preferably small. The number of filaments in the multifilament for the loop fastener element employed in the present invention is slightly smaller than 10 to 24 filaments which are generally employed in known loop fastener elements. More preferred is a multifilament yarn having 6 to 8 filaments and a total fineness of 230 to 330 dtex.

The multifilament for forming the loop fastener element may be a paralleled yarn including the multifilament made from the polybutylene terephthalate-based polyester and a small number of another filament. Generally, loop fastener elements made of polyester multifilaments fall down and the individual filaments are easily bonded together by a pressure roll during the production of surface fastener, allowing the base fabric to be seen through the loops and deteriorating the appearance. These drawbacks have been avoided by increasing the number of filament in the multifilament for the loop fastener element to 10 or more, generally as large as 14 to 24, and by employing a treatment for separating the multifilament yarn into individual filaments.

In contrast, the loop fastener elements made of polybutylene terephthalate multifilaments are difficult to fall down and the individual filaments are difficult to be bonded together even by a pressure roll during the production of surface fastener. Therefore, the number of the filaments in the multifilament yarn can be reduced to 5 to 9, as compared with that in the polyethylene terephthalate multifilament employed in the conventional techniques. Furthermore, the reduced number of the filaments in the multifilament yarn is effective because the hook fastener elements easily penetrate into the loop fastener elements and the loop fastener elements are made difficult to be pulled out of the base fabric during repeated engagement and disengagement.

The multifilaments for the loop fastener elements of the mixed surface fastener (C) are preferably made from the polybutylene terephthalate-based polyester. The Young's modulus of the multifilament is preferably 15 to 35 cN/dtex because the loop fastener elements are flexible, the loop fastener element is easily separated into individual filaments, and the hook fastener elements easily catch the loop fastener elements to provide a high engagement strength even when engaged by a small load. Therefore, the process for separating into individual filaments, for example, by rubbing with a card clothing lightly can be omitted, eliminating the problem of damaging the coexisting hook fastener elements by a card clothing.

In the first embodiment of the invention 1, the height of the hook fastener element of the hook surface fastener (A) from the surface of the base fabric is preferably 1.3 to 3.0 mm, and the height of the loop fastener element of the loop fastener element (B) from the surface of the base fabric is preferably 1.8 to 3.5 mm. The density of the hook fastener elements of the hook surface fastener (A) is preferably 20 to 120/cm$^2$ and particularly preferably 30 to 60/cm$^2$. The density of the loop fastener elements of the loop surface fastener (B) when expressed by multifilaments per unit area is preferably 20 to 120/cm$^2$ and particularly preferably 30 to 60/cm$^2$.

In the mixed surface fastener (C) of the second embodiment of the invention 1, the height of the hook fastener element is preferably 1.5 to 3.0 mm, the height of the loop fastener element is preferably 1.6 to 4.0 mm, and the loop fastener element is higher than the hook fastener element preferably by 0.1 to 1.0 mm, because the touch to the surface of the surface fastener is soft. In a more preferred embodiment, the height of the hook fastener element is 1.8 to 2.5 mm, the height of the loop fastener element is 2.0 to 3.3 mm, and the loop fastener element is higher than the hook fastener element by 0.2 to 0.8 mm.

In the mixed surface fastener (C) of the second embodiment of the invention 1, the density of the hook fastener elements is preferably 15 to 50/cm$^2$ and particularly preferably 20 to 40/cm$^2$. The density of the loop fastener elements when expressed by multifilaments per unit area is preferably 15 to 50/cm$^2$ and particularly preferably 20 to 40/cm$^2$. The ratio expressed by:

$$100\times(\text{number of loop fastener elements})/(\text{number of loop fastener elements}+\text{number of hook fastener elements})$$

is preferably 30 to 70 and particularly preferably 45 to 55.

In the invention 1, the monofilaments for forming the hook fastener element of the hook surface fastener (A) of the first embodiment and the monofilaments for forming the hook fastener element of the mixed surface fastener (C) of the second embodiment are fed into the base fabric in parallel to the ground warp yarns and passed over the ground warp yarn at selected locations to form a loop so as to allow the resultant hooks to extend in a direction away from the direction of the ground warp yarns. The multifilaments for forming the loop fastener elements of the loop surface fastener (B) and the multifilaments for forming the loop fastener elements of the mixed surface fastener (C) are fed into the base fabric in parallel to the ground warp yarns and allowed to run not passing over the ground warp yarns to form the loops extending almost in parallel to the ground warp yarns. By forming the hooks and loops in this manner, the hook fastener elements are preferably made easy to catch the loop fastener elements.

In the first embodiment, the base fabric (ground weave) of the hook surface fastener is heat-treated to fix the loop shapes. In the surface fastener combination of the invention, the heat applied to fix the loop shapes simultaneously fuses the heat fusible fiber forming the base fabric to anchor the loop fastener elements and the hook fastener elements to the base fabric. Therefore, the heat-treatment temperature is selected so as to fuse the heat fusible fiber and thermally anchor the monofilaments for forming the hook fastener elements, preferably from 150 to 250° C., and more preferably from 185 to 220° C.

The hook fastener elements of the hook surface fastener (A) are formed by cutting one leg of each loop on the fabric for forming the hook surface fastener by a cutting machine which cuts one leg of each loop. A cutting machine capable of cutting only one leg of each loop for forming the hook fastener elements which extends in the direction of the ground warp yarns by a movable cutting blade which reciprocates between two stationary blades is preferably used. To cut only one leg of each loop, the loops for forming the hook fastener elements are preferably formed at positions where the monofilament passes over the ground warp yarn, as mentioned above.

In the mixed surface fastener (C) of the second embodiment, the hook fastener elements are formed in a similar manner by cutting one leg of each monofilament loop formed on the base fabric preferably by a cutting machine which cuts one leg of each monofilament loop by a movable cutting blade which reciprocates between two stationary blades, but does not cut multifilament loops in the loop fastener element region. To ensure the cutting of one leg of each monofilament loop for forming the hook fastener elements without cutting the loop fastener elements, it is recommended to form the loops for the hook fastener elements in at least two rows as shown in FIG. 1A.

In the first embodiment of the invention 1, the ground warp yarn for forming the each base fabric of the hook surface fastener (A), the loop surface fastener (B) and the combination thereof is preferably a polyester multifilament yarn, particularly preferably a highly heat-resistant polyethylene terephthalate-based multifilament yarn. These multifilament yarns may include a small amount of a copolymerized component, another polymer, and another filament. The ground warp yarns continuously extend in the length-wise direction of the surface fastener, and the stability to processes for producing the surface fastener is attributable to the ground warp yarns. Therefore, a yarn showing little change, such as shrinkage, under the heat treatment conditions is preferably used, and a yarn made from a polyethylene terephthalate homopolymer is more preferably used.

In the first embodiment of the invention 1, the ground warp yarn for forming the hook surface fastener (A) and the loop surface fastener (B) is preferably a multifilament having 16 to 96 filaments and a total fineness of 75 to 250 dtex, particularly preferably a multifilament having 24 to 48 filaments and a total fineness of 100 to 200 dtex. The multifilament yarns mentioned above are made into the base fabric to have a weave density of 45 to 90 yarns/cm when determined after the heat treatment.

As described above, the monofilaments for forming the hook fastener elements and the multifilaments for forming the loop fastener elements are fed into the base fabric in parallel to the ground warp yarns. The feeding number of each the monofilaments and the multifilaments is preferably 3 to 8 per 20 ground warp yarns (inclusive of the monofilaments for forming the hook fastener elements and the multifilaments for forming the loop fastener elements) when determined after the heat treatment mentioned below.

In the second embodiment of the invention 1, the ground warp yarn for forming the base fabric of the mixed surface fastener (C) is preferably a polyester multifilament yarn, particularly preferably a highly heat-resistant polyethylene terephthalate-based multifilament yarn. These multifilament yarns may include a small amount of a copolymerized component, another polymer, and another filament. The ground warp yarns continuously extend in the length-wise direction of the surface fastener, and the stability to processes for producing the surface fastener is attributable to the ground warp yarns. Therefore, a yarn showing little change, such as shrinkage, under the heat treatment conditions is preferably used, and a yarn made from a polyethylene terephthalate homopolymer is more preferably used.

In the second embodiment of the invention 1, the ground warp yarn for forming the base fabric of the mixed surface fastener (C) is preferably a multifilament having 12 to 96 filaments and a total fineness of 75 to 250 dtex and particularly preferably a multifilament having 24 to 48 filaments and a total fineness of 100 to 170 dtex. The multifilament yarns mentioned above are made into the base fabric to have a weave density of ground warp yarns of 60 to 90 yarns/cm when determined after the heat treatment.

As described above, the monofilaments for forming the hook fastener elements and the multifilaments for forming the loop fastener elements are fed into the base fabric in parallel to the ground warp yarns. The total feeding number of the monofilaments and the multifilaments is preferably 3 to 6 per 20 ground warp yarns (inclusive of the monofilaments for forming the hook fastener elements and the multifilaments for forming the loop fastener elements).

In the invention 1, the ground weft yarn for forming the base fabric of the surface fasteners (A) and (B) of the first embodiment and the ground weft yarn for forming the base fabric of the mixed surface fastener (C) of the second embodiment are preferably made from a polyester resin which can be fused under the heat treatment conditions mentioned above to firmly anchor the monofilaments for the hook fastener elements and the multifilaments for the loop fastener elements to the base fabric at their roots. For example, a sheath-core polyester fiber wherein the sheath component is fused under the heat treatment conditions, but the core component is not fused is preferably used. Examples thereof include a sheath-core polyester fiber wherein the core component comprises a polyethylene terephthalate and the sheath component comprises a polyethylene terephthalate copolymer copolymerized with a large amount, for example, 20 to 30 mol % of a copolymerizable component, such as isophthalic acid and adipic acid. The melting point or softening point of the sheath component is preferably 100 to 200° C. and 20 to 150° C. lower than the melting points of the ground warp yarn, the monofilament for the hook fastener elements, and the multifilament for the loop fastener elements.

Preferably, substantially all the ground weft yarns are made of sheath-core heat fusible fibers, because the hook fastener elements and the loop fastener element are firmly anchored to the base fabric. If the entire part of the ground weft yarn is made from a heat fusible polymer, since the heat fusible polymer which is fused and then re-solidified is fragile and easy to break, the base fabric of the resultant surface fastener sewed onto an object is likely to tear from the sewed portion. Therefore, the heat fusible fiber preferably comprises a heat-fusible resin component and a non-heat fusible resin component, for example, in the form of a sheath-core cross section. The weight ratio of the core component and the sheath component is preferably 20:80 to 80:20.

To firmly anchor the hook fastener elements and the loop fastener elements to the base fabric, it is preferred that the heat fusible fibers used as the ground weft yarns are fusion-bonded to them and, in addition, tighten the roots of the hook fastener elements and the loop fastener elements from both sides by shrinking. To effectively tighten the roots, a heat fusible fiber which shrinks largely under the heat treatment conditions is preferably used. The dry heat shrinkage of the heat fusible fiber is preferably 8 to 20%, more preferably 11 to 18% when measured after heating at 200° C. for one minute.

In the first embodiment of the invention 1, the ground weft yarn for forming the base fabric of the surface fasteners (A) and (B) is preferably a multifilament having 24 to 72 filaments and a total fineness of 75 to 300 dtex and particularly preferably a multifilament having 24 to 48 filaments and a total fineness of 75 to 200 dtex. The multifilament yarns mentioned above are fed into the base fabric in a weave density of 15 to 30 yarns/cm when determined after the heat treatment. The weight ratio of the ground weft yarns is preferably 15 to 40% of the total of the ground warp yarns, the ground weft yarns, and the monofilaments for hook fastener elements or the multifilaments for the loop fastener elements.

In the second embodiment of the invention 1, the ground weft yarn for forming the base fabric of the mixed surface fastener (C) is preferably a multifilament having 12 to 72 filaments and a total fineness of 100 to 300 dtex and particularly preferably a multifilament having 24 to 48 filaments and a total fineness of 150 to 250 dtex. The above multifilament yarns are fed into the base fabric in a weave density of 15 to 25 yarns/cm when determined after the heat treatment. The weight ratio of the ground weft yarns is preferably 15 to 40% of the total of the monofilaments for the hook fastener elements, the multifilaments for the loop fastener elements, the ground warp yarns, and the ground weft yarns.

In the mixed surface fastener (C) of the second embodiment of the invention 1, the monofilaments for forming the hook fastener elements and the multifilaments for forming the loop fastener elements are fed to the base fabric also in parallel to the ground warp yarns and passed over the ground warp yarn at selected locations to form the loops. Like the first embodiment, the base fabric is heat-treated generally at 150 to 250° C., more preferably at 185 to 220° C. to fix the loop shapes.

In the first embodiment of the invention 1, as described above, since the fibers forming the base fabric are fusion-bonded to each other, the surface fastener can be suitably used without coating the back surface of the base fabric with an adhesive (back coat resin) as employed in the conventional techniques. However, the back surface of the base fabric can be coated with an adhesive, if desired. In this case, the ground weft yarn for forming the base fabric is not needed to be a heat fusible fiber, and the ground warp yarn and the ground weft yarn for forming the base fabric are not needed to be polyester fibers. However, in view of the dyeability, the ground warp yarn and the ground weft yarn are both preferably polyester fibers, and the ground weft yarn is preferably a heat fusible binder fiber.

The textile weave of the base fabric is preferably a plain weave in which the monofilaments for the hook fastener elements or the multifilaments for the loop fastener elements function as a part of the ground warp yarns. The yarns for the fastener elements extend in parallel to the ground warp yarns. In the hook surface fastener (A), the textile weave wherein the yarn for the fastener elements projects from the base fabric at selected portions, passes over 1 to 3 ground warp yarns to form a loop, and then passes under the ground warp yarns is preferred. In the loop surface fastener (B), the textile weave wherein the yarn for the fastener elements extends in parallel to the ground warp yarns without passing over the ground warp yarn is preferred. The above textile weaves make it easy to cut only one leg of the loop and allow the hook fastener element to easily engage with the loop fastener element.

In the mixed surface fastener (C) of the second embodiment of the invention 1, the textile weave of the base fabric is preferably a plain weave in which both the monofilaments for the hook fastener elements and the multifilaments for the loop fastener elements function as a part of the ground warp yarns. The textile weave wherein the yarn for fastener elements projects from the base fabric, passes over 1 to 4 ground warp yarns to form a loop, and then passes under the ground warp yarns is preferred, because the loops for hook fastener elements can be cut at their one leg without damaging the loop fastener elements.

The first embodiment of the invention 1 includes a combination of the hook surface fastener (A) and the loop surface fastener (B), wherein the base fabrics of both the hook surface fastener (A) and the loop surface fastener (B) are integrally boded to each other with the surfaces which carry the fastener elements facing outward, i.e., a surface fastener wherein one of the surfaces functions as a hook surface fastener and the other functions as a loop surface fastener. The base fabric of the hook surface fastener (A) and the base fabric of the loop surface fastener (B) can be integrally bonded to each other by an adhesive, a glue, a thermal fusion-bonding, sewing, or a needle-punching of overlaid fasteners.

In the invention 1, the hook surface fastener (A) and the loop surface fastener (B) of the first embodiment, the mixed surface fastener (C) of the second embodiment, and any combination thereof can be used in applications in which conventional surface fasteners are used, for example, wide variety of applications including shoes, bags, headwear, gloves, clothes, sphygmomanometers, supporters, packing bands, binding tapes, toys, fixation of sheet for civil engineering and construction, fixation of panels and wall materials, fixation of solar cell panel on roofs, fixation of electronic parts, assembling and disassembling storage boxes and packing cases, small articles, and curtains.

The double-side surface fastener wherein the base fabric of the hook surface fastener (A) and the base fabric of the loop surface fastener (B) are integrally bonded to each other is useful as a tying band, particularly as a fastening band.

When the surface fasteners or the combination thereof of the invention 1 are completely made of polyester fibers, the surface fasteners can be dyed in uniform color without color shading. In particular, when clothes are made of polyester fibers, the surface fasteners and clothes are simultaneously dyed in the same color under the same dying conditions. Therefore, there is no need to prepare various surface fasteners with variant colors in advance so as to match the dyed color of clothes, this making the present invention extremely preferable over the conventional techniques.

The invention 2 relates to a combination of a hook fastener element and a loop fastener element for surface fastener, wherein the loop fastener element is capable of engaging with the hook fastener element. The hook fastener element comprises a monofilament comprising a polyethylene terephthalate-based polyester resin. The loop fastener element comprises a multifilament comprising a polybutylene terephthalate-based polyester resin.

Specifically, the combination comprises the surface fasteners mentioned above in detail with respect to the invention 1, for example, (i) a combination of the hook surface fastener (A) and the loop surface fastener (B), (ii) a combination of a mixed surface fasteners (C) and another, and (iii) a combination of the hook surface fastener (A) or the loop surface fastener (B) with the mixed surface fastener (C), in which the hook and loop elements are combined so as to achieve the engagement function required for the surface fasteners.

In view of actual use, the hook fastener elements formed on the surface of the base fabric of the hook surface fastener (A) and the loop fastener elements formed on the surface of the base fabric of the loop surface fastener (B) can be combinedly used.

In addition, a mixed surface fasteners (C) and another, each having the hook fastener elements and the loop fastener elements on the same surface of the base fabric, can be combinedly used.

In the invention 2, since the multifilaments forming the loop fastener elements of the loop surface fastener (B) or the mixed surface fastener (C) are made from a polybutylene terephthalate-based polyester, each loop fastener element is easily separated into individual filaments to allow the hook fastener elements of the hook surface fastener (A) or the mixed surface fastener (C) to easily catch the loops. In addition, since the monofilaments forming the hook fastener elements of the hook surface fastener (A) or the mixed surface fastener (C) are made from a rigid polyethylene terephthalate-based polyester, the hook fastener elements are difficult to disengage from the loop fastener elements of the loop surface fastener (B) and difficult to fall down, thereby enhancing the engagement strength.

In a preferred embodiment, the ground weft yarns and the ground warp yarns forming the base fabric are both made of polyester fibers. When fusing the ground weft yarns, the hook fastener elements and the loop fastener elements both made of polyester fibers are firmly anchored to the base fabric by fusion bonding. Therefore, the fastener elements are hardly pulled out of the base fabric even by repeated engagement and disengagement to assure a highly durable engagement strength.

In another preferred embodiment, the hook fastener elements, the loop fastener elements, the ground warp yarns, and the ground weft yarns, which form the hook surface fastener (A), the loop surface fastener (B) and the mixed surface fastener (C), are all made of polyester fibers. In contrast to using polyamide fibers, the significant deterioration of the fiber properties caused by heat degradation during the thermal fusion bonding and the waving of the surface fastener due to moisture or water absorption can be avoided.

There is no need to coat the back surface of the hook surface fastener (A), the loop surface fastener (B) and the mixed surface fastener (C) with an adhesive (back coat resin) to anchor the fastener elements. Therefore, the surface fastener is soft and has beautiful gloss, thus being usable as a substitute for buttons in clothing applications which require soft feel and beautiful gloss.

Since almost all the fibers which form the surface fastener are made of polyester fibers, the surface fastener is dye in uniform color by the same dying process and free from the problem of color shading due to the difference in the dyeability between different types of fibers.

EXAMPLES

The present invention will be described with reference to the examples. However, it should be noted that the present invention is not limited to the examples. In the following examples, the dry heat shrinkage was measured according to JIS L1013, and the engagement strength was measured according to JIS L3416 using a surface fastener with a 100 mm width.

Example 1

The following warp yarn and weft yarn were used for forming the base fabric of surface fastener, the following monofilament was used for forming the hook fastener element, and the following multifilament was used for forming the loop fastener element.

Warp Yarn

- Multifilament yarn made from polyethylene terephthalate having a melting point of 260° C.
- Total fineness: 167 dtex
- Number of filaments: 30

Weft Yarn

- Heat fusible multifilament yarn made of sheath-core composite fibers.
- Core component: polyethylene terephthalate (melting point: 260° C.)
- Sheath component: polyethylene terephthalate copolymerized with 25 mol % isophthalic acid (softening point: 190° C.)
- Sheath-core ratio (by weight): 70:30
- Total fineness: 99 dtex
- Number of filaments: 24
- Dry heat shrinkage at 200° C.: 13%

Monofilament for Hook Fastener Element

- Polyethylene terephthalate fiber (melting point: 260° C.)
- Fineness: 390 dtex (diameter: 0.19 mm)

Multifilament for Loop Fastener Element

- Polybutylene terephthalate fiber (melting point: 220° C.)
- Total fineness: 265 dtex
- Number of filaments: 7

The hook surface fastener (A) and the loop surface fastener (B) were produced using the four kinds of yarns described above.

Hook Surface Fastener (A)

The warp yarns, the weft yarns, and the monofilaments for hook fastener elements each described above were woven into a plain weave having a weave density (after heat-shrinking treatment) of 55 warps/cm and 20 wefts/cm. One monofilament for hook fastener elements was fed for every 4 warp yarns in parallel to the warp yarns. Each monofilament for hook fastener elements was allowed to run alternately over and under 5 weft yarns and then pass over 3 warp yarns to form a loop, thereby forming the loops on a base fabric.

The tape for the hook surface fastener obtained above was heat-treated at a temperature (200° C.) within a temperature range at which only the sheath component of the ground weft yarns was thermally fused, but the ground warp yarns, the monofilament for hook fastener elements and the core component of the ground weft yarns were not thermally fused. The ground weft yarns shrunk largely and bonded to adjacent yarns with the fused sheath component. As a result, the base fabric shrunk by 9% in the weft direction. After cooling, the loops were cut at their one leg to form the hook fastener elements.

In the obtained hook surface fastener (A), the hook fastener element density was 42 elements/cm$^2$, and the height of the hook fastener elements from the base fabric surface was 1.8 mm.

Loop Surface Fastener (B)

The warp yarns, the weft yarns, and the multifilament for loop fastener elements each described above were woven into a plain weave having a weave density (after heat-shrinking treatment) of 55 warps/cm and 22 wefts/cm. One multifilament for loop fastener elements was fed for every 4 warp yarns in parallel to the warp yarns. Each multifilament for loop fastener elements was allowed to run without passing over the warp yarn and form a loop after passing alternately over and under 5 weft yarns, thereby forming the loops on a base fabric.

The tape for the loop surface fastener obtained above was heat-treated at a temperature (200° C.) within a temperature range at which only the sheath component of the ground weft yarns was thermally fused, but the ground warp yarns, the multifilament for loop fastener elements and the core component of the ground weft yarns were not thermally fused. The ground weft yarns shrunk largely and bonded to adjacent yarns with the fused sheath component. As a result, the base fabric shrunk by 12% in the weft direction. After cooling, a loop surface fastener (B) was obtained, in which the loop fastener element density was 44 elements/cm$^2$, and the height of the loop fastener elements from the base fabric surface was 2.4 mm.

The obtained hook surface fastener (A) and loop surface fastener (B) were both dyed into luxury dark blue color under high pressure conditions capable of dyeing polyethylene terephthalate fibers. As compared with conventional surface fasteners generally used, in which the back surface is coated with a resin (back coat resin) to prevent fastener elements from being pulled out, the base fabrics of the dyed hook surface fastener (A) and loop surface fastener (B) were extremely soft. Therefore, a considerable deterioration in drapeability, shape and wearing comfort which can be caused by a hard base fabric were not observed in clothes, etc. to which the dyed hook surface fastener (A) and loop surface fastener (B) were attached by sewing. In addition, after immersing the hook surface fastener (A) and the loop surface fastener (B) in water for 10 min, no change was found in their shapes and engagement strength, and the base fabric remained flat.

The obtained surface fasteners were measured for the engagement strength. The results are shown in Table 1.

The engagement strength was measured in the shearing direction and the separating direction of a surface fastener with 100 mm width. The engagement strength was extremely high. In addition, the engagement strength after repeating engagement and disengagement 5000 times was measured. The results are shown in Table 1.

As seen from Table 1, the initial engagement strength was high and highly durable, because the engagement strength was hardly reduced even after repeating engagement and disengagement 5000 times. The multifilaments forming the loop fastener elements were observed under an optical microscope. The loop portion of each multifilament separated into individual filaments and spread horizontally. This may be attributable to the increase in the number of loops to be caught by the hook fastener elements and the loop shape retention even after repeating engagement and disengagement, thereby enhancing the engagement strength. In addition, since the hook fastener elements were rigid, the hooks were difficult to open to retain the hook shape, and the hook fastener elements were difficult to fall down. Further, the hook fastener elements and the loop fastener elements were arranged so as to be easily engaged with each other. All of these are attributable to the improvement of the engagement strength.

Comparative Example 1

A loop surface fastener (B) was produced in the same manner as in Example 1 except for using a multifilament for loop fastener elements made from polyethylene terephthalate (melting point: 260° C., total fineness: 265 dtex, number of filaments: 7) to form the loop fastener elements.

The obtained loop surface fastener (B) and the hook surface fastener obtained in Example 1 were engaged with each other and measured for the engagement strength. The results are shown in Table 1.

As seen from Table 1, the initial engagement strength and the engagement strength after repeating engagement and disengagement 5000 times were both poor as compared with those in Example 1. Observation on the multifilaments showed that individual filaments remained bundled together in each multifilament without separated into individuals. This may be attributable to the poor engagement strength. After repeating engagement and disengagement 5000 times, it was found that the multifilament was separated into individual filaments to increase the engagement strength from the initial value, although still inferior to that of Example 1.

Comparative Example 2

A hook surface fastener (A) was produced in the same manner as in Example 1 except for using a monofilament for hook fastener elements made from polybutylene terephthalate (melting point: 220° C., fineness: 435 dtex (diameter: 0.20 mm)) to form the hook fastener elements.

The obtained hook surface fastener (A) and the loop surface fastener (B) obtained in Example 1 were engaged with each other and measured for the engagement strength. The results are shown in Table 1.

As seen from Table 1, the initial engagement strength and the engagement strength after repeating engagement and disengagement 5000 times were both poor as compared with those in Example 1.

The hook fastener elements were easily deflected to open the hooks, and therefore, disengaged from the loop fastener elements by a small pulling force. In addition, the hook fastener elements were easy to incline by a small pressing load. Therese may be attributable to the low engagement strength.

Comparative Example 3

The loop surface fastener (B) obtained in Comparative Example 1 and the hook surface fastener (A) obtained in Comparative Example 2 were engaged with each other and measured for the engagement strength. The results are shown in Table 1.

As seen from Table 1, the initial engagement strength and the engagement strength after repeating engagement and disengagement 5000 times were both poor as compared with those in Example 1. Observation on the fastener elements showed that individual filaments remained bundled together in each multifilament without separated into individuals; the hook fastener elements were easily deflected to open the hooks, and therefore, disengaged from the loop fastener elements by a small pulling force; and the hook fastener elements were easy to incline by a small pressing load. All of these may be attributable to the low engagement strength.

TABLE 1

| | | Comparative Examples | | |
|---|---|---|---|---|
| | Example 1 | 1 | 2 | 3 |
| Resins of fastener elements | | | | |
| hook surface fastener (A) | PET | PET | PBT | PBT |
| loop surface fastener (B) | PBT | PET | PBT | PET |
| Initial engagement strength | | | | |
| shear strength (N/cm$^2$) | 10.6 | 9.5 | 10.2 | 10.4 |
| peeling strength (N/cm) | 1.39 | 1.13 | 1.01 | 0.93 |
| Engagement strength after 5000 engagement and disengagement | | | | |
| shear strength (N/cm$^2$) | 11.8 | 11.1 | 8.6 | 9.0 |
| peeling strength (N/cm) | 1.25 | 1.15 | 1.04 | 0.92 |

PET: polyethylene terephthalate
PBT: polybutylene terephthalate

Example 2

A hook surface fastener (A) was produced in the same manner as in Example 1 except for changing the fineness of the monofilament made from polyethylene terephthalate to 300 dtex (diameter: 0.17 mm). The obtained hook surface fastener (A) and the loop surface fastener (B) obtained in Example 1 were engaged with each other and measured for the engagement strength. The results are shown in Table 2.

As seen from Table 2, the engagement strength of the surface fastener combination of Example 2 was slightly lower than that of Example 1, but much higher than those of the above comparative examples. Like the surface fasteners of Example 1, the change in shape, such as waving, was not found after immersing in water. As compared with the commercially available combinations of surface fastener fabrics which are coated with a back coat resin, the base fabric of Example 2 was extremely soft and suitable for clothing applications.

Example 3

A loop surface fastener (B) was produced in the same manner as in Example 1 except for using a multifilament for loop fastener elements made from polybutylene terephthalate (total fineness: 265 dtex, number of filaments: 10) to form the loop fastener elements. The obtained loop surface fastener (B) and the hook surface fastener (A) obtained in Example 1 were engaged with each other and measured for the engagement strength. The results are shown in Table 2.

As seen from Table 2, the surface fastener combination of this example had the initial engagement strength higher than that of Example 1, but reduced in the engagement strength after repeating engagement and disengagement 5000 times. The initial engagement strength was extremely higher than those of the above comparative examples. The observation on the loop fastener elements after repeating engagement and disengagement 5000 times showed that a considerable number of multifilaments forming the loop fastener elements were broken.

TABLE 2

| | Examples | |
|---|---|---|
| | 2 | 3 |
| Monofilament for hook fastener elements | 300 dtex PET monofilament | same as example 1 |
| Multifilament for loop fastener elements | same as example 1 | 265 dtex multifilament of 10 PBT filaments |
| Initial engagement strength | | |
| shear strength (N/cm$^2$) | 10.2 | 11.7 |
| peeling strength (N/cm) | 1.23 | 1.51 |
| Engagement strength after 5000 engagement and disengagement | | |
| shear strength (N/cm$^2$) | 11.2 | 11.0 |
| peeling strength (N/cm) | 1.24 | 1.15 |

PET: polyethylene terephthalate
PBT: polybutylene terephthalate
dtex: decitex

Comparative Example 4

A loop surface fastener (B) was produced in the same manner as in Example 1 except for using a nylon 6 multifilament (total fineness: 235 dtex, number of filaments: 10) to form the loop fastener elements. In the obtained loop surface fastener (B), the fastener elements were not anchored to the base fabric. When engaged with and then tried to disengage from the hook surface fastener (A) obtained in Example 1, the loop fastener elements were easily pulled out of the base fabric surface, and the base fabric surface was napped more and more as the engagement and disengagement were repeated. In addition, the force required to separate the engaged surface fasteners was increased as the engagement and disengagement were repeated, and finally the engaged surface fasteners could not be separated to lose the function as the surface fastener.

To prevent the pull-out from the base fabric surface, a polyurethane solution was coated to the back surface of the base fabric and then dried. The loop surface fastener (B) was hardened and severely lacked softness as compared with the surface fastener of Example 1. The loop surface fastener (B) before coating the polyurethane solution was engaged with the hook surface fastener (A) obtained in Example 1 immediately after immersing in water for 10 min. The number of the loop fastener elements pulled out of the base fabric surface during disengagement was increased, showing that the loop surface fastener (B) had no commercial value.

Example 4

The base fabric of surface fastener was made of the following warp yarn and weft yarn, the hook fastener element was made of the following monofilament, and the loop fastener element was made of the following multifilament.

Warp Yarn
- Multifilament yarn made from polyethylene terephthalate having a melting point of 260° C.
- Total fineness: 167 dtex
- Number of filaments: 30

Weft Yarn
- Heat fusible multifilament yarn made of sheath-core composite fibers.
- Core component: polyethylene terephthalate (melting point: 260° C.)
- Sheath component: polyethylene terephthalate copolymerized with 25 mol % isophthalic acid (softening point: 180° C.)
- Sheath-core ratio (by weight): 7:3
- Total fineness: 197
- Number of filaments: 48
- Dry heat shrinkage at 200° C. for one minute: 14%

Monofilament for Hook Fastener Element
- Polyethylene terephthalate fiber (melting point: 260° C.)
- Fineness: 390 dtex (diameter: 0.19 mm)

Multifilament for Loop Fastener Element
- Polybutylene terephthalate fiber (melting point: 220° C.)
- Total fineness: 265 dtex
- Number of filaments: 7

The four kinds of yarns described above were woven into a plain weave having a weave density of 72 warps/cm and 18 wefts/cm while feeding the monofilaments for hook fastener elements and the multifilaments for loop fastener elements so as to alternately form two rows of hook fastener elements and two rows of loop fastener elements each extending in the lengthwise direction with the rows of loop fastener elements disposed at both outer ends so that the loop fastener elements are touched to hand when handling the surface fastener. Two monofilaments for hook fastener elements were fed for every 8 warp yarns and two multifilaments for loop fastener elements were fed for every 8 warp yarns.

The fabric tape thus obtained was heat-treated at a temperature (200° C.) within a temperature range at which only the sheath component of the ground weft yarns was thermally fused, but the ground warp yarns, the multifilaments for loop fastener elements, the monofilaments for hook fastener elements, and the core component of the ground weft yarns were not thermally fused. The ground weft yarns shrunk largely and bonded to adjacent yarns with the fused sheath component. As a result, the base fabric shrunk largely by 10% in the weft direction. After cooling, the loops for hook fastener elements were cut at their one leg (leg more apart from the loop fastener elements) to form the hook fastener elements.

In the obtained mixed hook/loop surface fastener, the hook fastener element density was 30 elements/cm$^2$, the loop fastener element density was 31 elements/cm$^2$, and the heights of the hook fastener elements and the loop fastener elements from the base fabric surface were 1.7 mm and 2.2 mm, respectively.

The fastener elements of the obtained mixed hook/loop surface fastener were extremely soft to touch as compared with those of conventional surface fasteners. The base fabric was also very soft and flexible, and the surface fastener attached to a polyester cloth by sewing was foldable without any feel that a rigid surface fastener sheet was attached by sewing.

The obtained surface fastener was dyed under high pressure conditions capable of dyeing polyethylene terephthalate fibers. Since the temperature of dye diffusion into the polybutylene terephthalate fibers is about 20° C. lower than that into the polyethylene terephthalate fibers, the loop fastener elements were dyed to a dark color as compared with the dyed colors of the hook fastener elements, the ground warp yarns, and the ground weft yarns, thereby obtaining a surface fastener having a luxury appearance with a deep color.

The obtained surface fastener was measured for the engagement strength. The results are shown in Table 1.

As mentioned above, the engagement strength was measured in both the shearing direction and the separating direction of the surface fastener with a 100 mm width. The results showed the engagement strength was extremely high. Two pieces of the surface fasteners were engaged with each other and then disengaged repeatedly 5000 times, and thereafter, the engagement strength was measured. The results are shown in Table 1. As seen form Table 1, the engagement strength was not substantially reduced even after repeating engagement and disengagement 5000 times, showing that the surface fastener was highly durable.

Comparative Examples 5 and 6

A surface fastener was produced in the same manner as in Example 4 except for using multifilaments made from polyethylene terephthalate (melting point: 260° C., total fineness: 265 dtex, number of filaments: 7) to form the loop fastener elements (Comparative Example 5), or using monofilaments made from polybutylene terephthalate (melting point: 220° C., fineness: 390 dtex) to form the hook fastener elements (Comparative Example 6).

The surface fastener obtained in Comparative Example 5 was hard to touch as compared with that of Example 4. The surface fastener of Comparative Example 6 was extremely soft to touch. The observation on the surface showed that the multifilaments of Comparative Example 5 were tightly bundled to form thin loop fastener elements as compared with those of Example 4 and Comparative Example 6, and therefore, the base fabric surface of Comparative Example 5 could see through the loop fastener elements. The surface fasteners of these comparative examples were measured for the engagement strength. The results are shown in Table 3, which shows that the surface fasteners of Comparative Examples 5 and 6 are poor in the engagement strength as compared with that of Example 4.

Comparative Example 7

A surface fastener was produced in the same manner as in Example 4 except for using monofilaments made from nylon-66 (melting point: 255° C., fineness: 390 dtex) to form the hook fastener elements and using multifilaments made from nylon-6 (melting point: 220° C., total fineness: 265 dtex, number of filaments: 7) to form the loop fastener elements. Since it was expected that fibers for the fastener elements would not be sufficiently anchored to the base fabric, the back surface of the base fabric was coated with a polyurethane adhesive to anchor the fibers for fastener elements.

The surface of the obtained surface fastener was soft to touch, but its base fabric waved when wetted with water. The result of the measurement showed that, as shown in Table 3, the engagement strength was inferior to that of Example 4.

Comparative Example 8

A surface fastener was produced in the same manner as in Example 4 except for using multifilaments made from polyethylene terephthalate (melting point: 260° C., total fineness: 265 dtex, number of filaments: 7) to form the loop fastener elements and using monofilaments made from polybutylene terephthalate (melting point: 220° C., fineness: 390 dtex) to form the hook fastener elements. Although the obtained surface fastener was soft to touch, the engagement strength was far inferior to that of Example 4.

TABLE 3

| | Example 4 | Comparative Examples 5 | 6 | 7 | 8 |
|---|---|---|---|---|---|
| Resin of hook fastener elements | PET | PET | PBT | NY-66 | PBT |
| Resin of loop fastener element | PBT | PET | PBT | NY-6 | PET |
| Initial engagement strength | | | | | |
| shear strength (N/cm$^2$) | 13.1 | 10.9 | 9.3 | 9.07 | 8.9 |
| peeling strength (N/cm) | 1.28 | 0.99 | 0.65 | 1.06 | 0.72 |
| Engagement strength after 5000 engagement and disengagement | | | | | |
| shear strength (N/cm$^2$) | 10.2 | 9.9 | 7.9 | 7.5 | 8.2 |
| peeling strength (N/cm) | 1.14 | 1.13 | 0.63 | 1.03 | 0.69 |

PET: polyethylene terephthalate
PBT: polybutylene terephthalate
NY: nylon

Example 5

A surface fastener was produced in the same manner as in Example 4 except for using multifilaments made from polybutylene terephthalate (melting point: 220° C., total fineness: 350 dtex: number of filaments: 9) to form the loop fastener elements.

The surface of the obtained surface fastener was soft to touch but slightly hard as a whole, and the distance between the loop filaments was slightly narrow. The result of measurement showed that the initial engagement strength was larger than that of Example 4. Some of the filaments of the loop fastener elements were not sufficiently anchored to the base fabric, and some of the filaments were pulled out of the base fabric surface after repeating engagement and disengagement. However, the obtained surface fastener had a sufficient engagement function.

Example 6

A surface fastener was produced in the same manner as in Example 4 except for using monofilaments made from polyethylene terephthalate (623 dtex, diameter: 0.24 mm) to form the hook fastener elements.

Although the hook fastener elements were rigid, the rigid touch of the surface of the obtained surface fastener was significantly reduced by soft and higher loop fastener elements.

Although the shear strength of the obtained surface fastener was sufficiently high as compared with those of Examples 4 and 5, some loop fastener elements were cut by the hook fastener elements during repeated engagement and disengagement to show a slightly large decrease in the engagement strength after repeating engagement and disengagement 5000 times. However, the obtained surface fastener was sufficient for use in applications not requiring the durability.

The surface of the obtained surface fastener was less soft to touch than those of Examples 4 and 5, because the rigid hook fastener elements were directly touched by hand, showing the upper limit of the fineness of the hook fastener elements.

The engagement strength of each surface fastener of Examples 5 and 6 are shown in Table 4.

TABLE 4

| | Examples | |
|---|---|---|
| | 5 | 6 |
| Hook fastener elements | PET | PET 623T |
| Loop fastener elements | PBT 350T/9 | PBT |
| Initial engagement strength | | |
| shear strength (N/cm$^2$) | 14.1 | 15.4 |
| peeling strength (N/cm) | 1.43 | 1.12 |
| Engagement strength after 5000 engagement and disengagement | | |
| shear strength (N/cm$^2$) | 9.2 | 7.4 |
| peeling strength (N/cm) | 0.84 | 0.78 |

PET: polyethylene terephthalate
PBT: polybutylene terephthalate
. . . T/ . . . : total fineness/number of filaments

INDUSTRIAL APPLICABILITY

The hook surface fastener (A), the loop surface fastener (B), the mixed surface fastener (C), and any combination thereof of the invention can be widely used in the applications in which conventional surface fasteners have been used, for example, shoes, bags, headwear, gloves, clothes, sphygmomanometers, supporters, packing bands, binding tapes, toys, fixation of sheet for civil engineering and construction, fixation of panels and wall materials, fixation of solar cell panel on roofs, fixation of electronic parts, assembling and disassembling storage boxes and packing cases, small articles, and curtains.

A surface fastener in which the base fabric of the hook surface fastener (A) and the base fabric of the loop surface fastener (B) are integrally bonded to each other is effective, particularly as a tying band and a fastening band.

The hook surface fastener (A), the loop surface fastener (B), and the mixed surface fastener (C) of the invention are not needed to coat an adhesive (back coat resin) on the back surface to anchor the fastener elements. Therefore, the surface fastener has advantages of softness and beautiful gloss and can be used as a substitute for buttons of clothing applications that require softness and beautiful gloss.

What is claimed is:

1. A surface fastener:

comprising a hook surface fastener (A) comprising hook fastener elements comprising monofilaments on a surface of a base fabric (A), and a loop surface fastener (B) comprising loop fastener elements capable of engaging with the hook fastener elements and comprising multifilaments on a surface of a base fabric (B); or comprising a mixed surface fastener (C) comprising hook fastener elements comprising monofilaments and loop fastener elements comprising multifilaments both on a same surface of a base fabric (C), wherein the monofilaments comprise a polyethylene terephthalate-based polyester resin, and the multifilaments comprise a polybutylene terephthalate-based polyester resin, and wherein the base fabrics (A), (B), and (C) each comprise ground warp yarns comprising multifilaments comprising a polyethylene terephthalate-based polyester resin.

2. The surface fastener according to claim 1, wherein:

the base fabric (A), (B), and (C) comprises ground warp yarns and ground weft yarns each comprising a polyester resin;

the ground weft yarns comprise sheath-core heat fusible fibers; and the hook fastener elements and the loop fastener elements are anchored by fusion bonding to the ground weft yarns which form the base fabric (A), (B) and (C).

3. The surface fastener according to claim 1, wherein the multifilaments forming the loop fastener elements of the loop surface fastener (B) comprise 5 to 15 filaments and have a total fineness of 150 to 300 dtex.

4. The surface fastener according to claim 1, wherein the monofilaments forming the hook fastener elements of the hook surface fastener (A) have a diameter of 0.13 to 0.40 mm.

5. The surface fastener according to claim 1, wherein the base fabric (A) and the base fabric (B) are integrally bonded to each other with both the surfaces having the fastener elements disposed outside.

6. The surface fastener according to claim 1, wherein the multifilaments forming the loop fastener element of the mixed surface fastener (C) comprise 5 to 9 filaments and have a total fineness of 150 to 350 dtex.

7. The surface fastener according to claim 1, wherein the monofilaments forming the hook fastener element of the mixed surface fastener (C) have a diameter of 0.10 to 0.25 mm.

8. The surface fastener according to claim 1, wherein the mixed surface fastener (C) comprises at least one array of the hook fastener elements which is disposed adjacent to at least one array of the loop fastener elements.

9. The surface fastener according to claim 1, wherein the loop fastener elements of the mixed surface fastener (C) are higher than the hook fastener elements by 0.2 mm or more.

10. The surface fastener according to claim 1, wherein the Young's modulus of the monofilaments is 80 to 140 cN/dtex, and the Young's modulus of the multifilaments is 15 to 35 cN/dtex.

11. A surface fastener:

comprising a hook surface fastener (A) comprising hook fastener elements comprising monofilaments on a surface of a base fabric (A), and a loop surface fastener (B) comprising loop fastener elements capable of engaging with the hook fastener elements and comprising multifilaments on a surface of a base fabric (B); or comprising a mixed surface fastener (C) comprising hook fastener elements comprising monofilaments and loop fastener elements comprising multifilaments both on a same surface of a base fabric (C), wherein the monofilaments comprise a polyethylene terephthalate-based polyester resin, the multifilaments comprise a polybutylene terephthalate-based polyester resin, and wherein the hook fastener elements of the hook surface fastener (A) have a density of 20 to 120 elements/cm$^2$, and wherein the base fabrics (A), (B), and (C) each comprise ground warp yarns comprising multifilaments comprising a polyethylene terephthalate-based polyester resin.

12. A surface fastener:

comprising a hook surface fastener (A) comprising hook fastener elements comprising monofilaments on a surface of a base fabric (A), and a loop surface fastener (B) comprising loop fastener elements capable of engaging with the hook fastener elements and comprising multifilaments on a surface of a base fabric (B); or comprising a mixed surface fastener (C) comprising hook fastener elements comprising monofilaments and loop fastener elements comprising multifilaments both on a same surface of a base fabric (C), wherein the monofilaments comprise a polyethylene terephthalate-based polyester resin, the multifilaments comprise a polybutylene terephthalate-based polyester resin, and wherein the loop fastener elements of the loop surface fastener (B) have a density of 20 to 120 elements/$cm^2$, and wherein the base fabrics (A), (B), and (C) each comprise ground warp yarns comprising multifilaments comprising a polyethylene terephthalate-based polyester resin.

* * * * *